US006941087B2

(12) United States Patent
Hayashi et al.

(10) Patent No.: US 6,941,087 B2
(45) Date of Patent: Sep. 6, 2005

(54) IMAGE FORMING APPARATUS AND INITIALIZATION CONTROL METHOD THEREFOR

(75) Inventors: Yoshinori Hayashi, Soraku-gun (JP); Kazunori Miyamoto, Kashihara (JP); Kouichi Eto, Nara (JP); Motohiro Hayashi, Nara (JP); Takeshi Yamaguchi, Yamatokoriyama (JP); Masakazu Suzuki, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/406,986

(22) Filed: Apr. 3, 2003

(65) Prior Publication Data

US 2003/0194246 A1 Oct. 16, 2003

(30) Foreign Application Priority Data

Apr. 11, 2002 (JP) ..... P 2002-109473

(51) Int. Cl.[7] ..... G03G 15/20
(52) U.S. Cl. ..... 399/69; 399/70
(58) Field of Search ..... 219/216; 399/44, 399/45, 46, 69, 70

(56) References Cited

U.S. PATENT DOCUMENTS 6,501,919 B1 * 12/2002 Yamaguchi ..... 399/70

FOREIGN PATENT DOCUMENTS

JP 62-006277 1/1987

* cited by examiner

*Primary Examiner*—Hoang Ngo
(74) *Attorney, Agent, or Firm*—Edwards & Angell, LLP; David G. Conlin; George W. Hartnell, III

(57) ABSTRACT

An immediate printing type image forming apparatus is provided of which the warm-up time is sufficiently shortened without causing any trouble to occur in the execution of image reading processing and/or image forming processing. The image forming apparatus is configured to determine a time required to raise the current temperature of the surface of a heating roller in a fixing unit to a predetermined temperature and increase the duty ratio of a power waveform to be fed to each of a copy lamp and a motor driving a polygon mirror when the time required thus determined is shorter than each of a time required to increase the current light quantity of the copy lamp to a predetermined light quantity and a time required to raise the current rotational speed of the motor to a predetermined speed, thereby turning each of the copy lamp and the motor into respective predetermined condition before the elapse of the determined time required.

18 Claims, 6 Drawing Sheets

IMAGE FORMING APPARATUS AND INITIALIZATION CONTROL METHOD THEREFOR

BACKGROUND OF THE INVENTION

1. Field of the Invention

This invention relates to image forming apparatus for forming images electrophotographically such as copying machines and to an initialization control method for turning function devices included in such an image forming apparatus into their respective predetermined operable conditions after energization thereof.

2. Description of the Related Art

A certain length of time is required for function devices included in an electrophotographic image forming apparatus such as a fixing unit, light-source lamp unit and laser scanning unit to reach their respective operable conditions from the starting of energization thereof. The fixing unit, which functions to fuse a toner image and pressure-bond the fused toner image to a recording medium by heating and pressurizing the recording medium after a transfer step, needs to be heated to a predetermined temperature that allows the toner image to be fused from the starting of image forming processing. The light-source lamp unit, which functions to emit light for reading image information from an original document placed on a platen, needs to emit a predetermined quantity of light for obtaining image data of a proper density from the starting of image reading processing. The laser scanning unit, which functions to scan the surface of a photosensitive member with laser light modulated according to image data, has a polygon mirror for scanning with laser light in a primary scanning direction, which polygon mirror needs to rotate at a predetermined speed from the starting of the image forming processing.

Thus, such an electrophotographic image forming apparatus waits for the function devices of the apparatus to turn into their respective predetermined operable conditions (inclusive of the aforementioned predetermined temperature, predetermined light quantity and predetermined speed) after the starting of energization of the function devices and then starts the image reading processing and the image forming processing. When the units included in the apparatus turn into their respective predetermined operable conditions after the image forming apparatus has been powdered on or re-powered on following settlement of jam or the like, a ready lamp in a display section of the apparatus is turned on to notify the user that the image forming apparatus becomes ready for use.

Heretofore, the time required for the function devices of an image forming apparatus to turn into their respective predetermined operable conditions from the powering-on of the apparatus has been determined by the time required for the fixing unit to reach the predetermined temperature. The time required for the fixing unit to reach the predetermined temperature is what is called "warm-up time". During the warm-up time of the image forming apparatus, preparations for the starting of image reading processing and image forming processing are made including operations such as to check and adjust the thickness of toner and to initialize the processing parts including the photosensitive member, .while the light-source lamp unit and the polygon mirror of the laser scanning unit are caused to reach the predetermined light quantity and the predetermined rotational speed, respectively. Controls exercised to effect these operations constitute initialization control of the image forming apparatus.

With the development of power-saving image forming apparatus proceeding in these years, the number of apparatus that require a few minutes' warm-up time like conventional apparatus is decreasing, while on the other hand the development of image forming apparatus of the immediate printing type which is capable of starting the image forming operation at substantially the same time with power-on is proceeding. In such an immediate printing type image forming apparatus, the efficiency in raising the temperature of a fusing roller (heating roller) included in the fixing unit by means of a heat source is improved by rendering the fusing roller thinner or by like means, thereby shortening the warm-up time. However, the following problems arise with such immediate printing type image forming apparatus if the warm-up time is determined only by the time required to raise the temperature of the fixing unit up to the predetermined temperature.

That is, as the case may be, a relatively long time is needed not only to raise the temperature of the fixing unit up to the predetermined temperature but also to turn other function devices such as the light-source lamp unit and laser scanning unit into their respective predetermined operable conditions during the warm-up time of the image forming apparatus. This is because the quantity of light emitted from a cold cathode tube that is used as the light-source lamp unit for power saving depends on the bulb temperature of the cold cathode tube and, hence, a prolonged time is required for the cold cathode tube to reach the predetermined light quantity, and because the rotational speed of the polygon mirror included in the laser scanning unit is rising with rising resolution and, hence, a sufficient acceleration time is required to raise the rotational speed of the motor driving the polygon mirror sufficiently.

For this reason, if the warm-up terminates in a short time from power-on at the time when the fixing unit reaches the predetermined temperature, the ready lamp in the display section is turned on even though other function devices of the apparatus than the fixing unit are not ready to operate and, hence, it is possible for the apparatus to accept an instruction from the user to start image reading processing and image forming processing despite the apparatus not in a ready-to-operate state as a whole.

If the image reading processing and image forming processing are executed with the apparatus not in the ready-to-operate state, troubles occur in the image reading processing and image forming processing such that images on an original document are not read normally due to an insufficient quantity of light emitted from the light-source lamp unit and that such images are written inaccurately on the photosensitive member due to the polygon mirror of the laser scanning unit rotating at an insufficient rotational speed. Thus, proper image formation becomes impossible.

In attempt to overcome the foregoing problem, a prior-art image forming apparatus disclosed in Japan Patent Laid Open sho No. 62-6277 is configured to terminate the warm-up after .detection is made of both of the two facts that: the temperature of the fixing unit has reached a predetermined temperature that allows a toner image to fuse; and the light quantity of the light-source lamp unit has reached a predetermined light quantity that allows images on an original document to be read accurately. Also, there have been proposed a number of configurations to terminate the warm-up after the satisfaction is made of both of the two conditions that: the temperature of the fixing unit has reached a predetermined temperature that allows a toner image to fuse; and the rotational speed of the polygon mirror in the laser scanning unit has reached a predetermined speed that allows images to be accurately written on the photosensitive member with laser light.

However, with such prior-art configurations to terminate the warm-up at the time when both of the temperature of the fixing unit and the light quantity of the light-source lamp unit have reached the predetermined temperature and the predetermined light quantity, respectively, or when both of the temperature of the fixing unit and the rotational speed of the polygon mirror in the laser scanning unit have reached the predetermined temperature and the predetermined speed, respectively, the warm-up time cannot be shortened sufficiently, but the warm-up is merely terminated upon elapse of the time required for the temperature of the fixing unit to reach the predetermined temperature, the time required for the light quantity of the light-source lamp unit to reach the predetermined light quantity, or the time required for the rotational speed of the polygon mirror in the laser scanning unit to reach the predetermined speed, whichever the longest. This does not lead to the realization of an immediate printing type image forming apparatus.

SUMMARY OF THE INVENTION

Accordingly, it is an object of the present invention to realize an immediate printing type image forming apparatus which is capable of sufficiently shortening its warm-up time without causing any trouble to occur in image reading processing and/or image forming processing by turning all other function devices than a fixing unit into respective predetermined operable conditions before the time when the temperature of the fixing unit reaches the predetermined temperature.

With a view to resolving the foregoing problem, the present invention provides an image forming apparatus comprising:

a fixing unit operative to heat a recording medium bearing a toner image transferred thereto at a predetermined temperature;

at least one function device other than the fixing unit for use in image formation;

a first memory storing information on a relationship between a current temperature of the fixing unit and a time required for the fixing unit to reach a predetermined temperature; and a controller operative to determine a time required corresponding to a current temperature of the fixing unit measured immediately after starting of energization from the information on the relationship stored in the first memory and modify control over the at least one function device to turn the at least one function device into a predetermined condition within the determined time required.

The image forming apparatus of this configuration measures a current temperature of the fixing unit immediately after energization of function devices, determines the time required corresponding to the current temperature from the information on the relationship stored in the memory, and modifies control over the function devices so that the function devices are turned into respective predetermined conditions suited for the execution of image forming processing within the time required thus determined. Accordingly, the time required for each of other function devices than the fixing unit to turn into respective predetermined condition is adjusted depending on the time required for the fixing unit to reach the predetermined temperature from the starting of energization and, when the fixing unit reaches the predetermined temperature suited to heat the recording medium after energization of the function devices, the other function devices have been turned into their respective predetermined conditions suited for the execution of image forming processing. As a result, the warm-up time can be shortened without any trouble in image reading processing and/or image forming processing.

The foregoing and other objects, features and attendant advantages of the present invention will become apparent from the reading of the following detailed description in conjunction with the accompanying drawings.

DESCRIPTION OF THE PREFERRED EMBODIMENTS

The present invention will now be described in detail with reference to the accompanying drawings.

Figure 1:
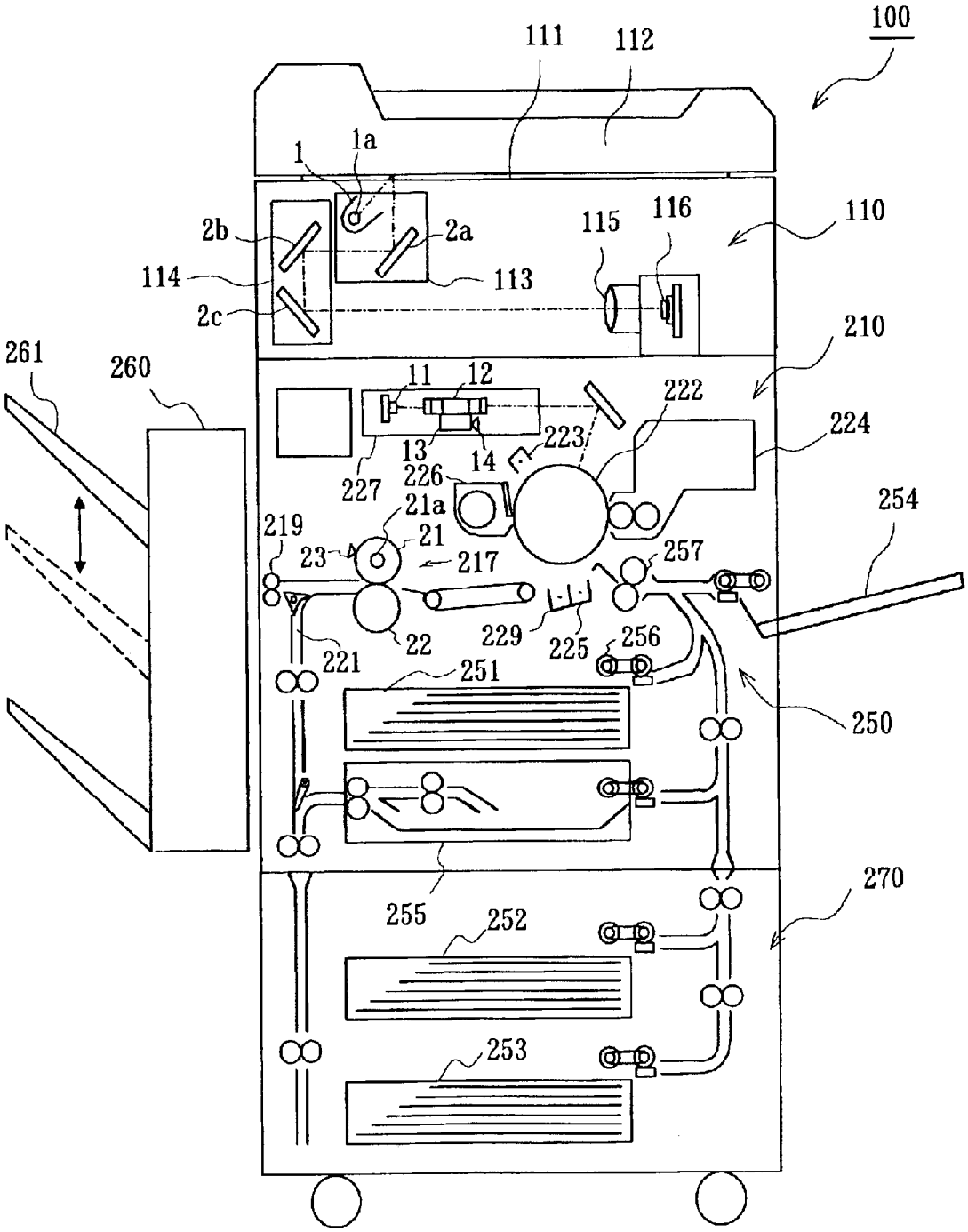
FIG. 1 is an illustration schematically showing the construction of an image forming apparatus according to an embodiment of the present invention.

Referring first to FIG. 1, there is shown an image forming apparatus 100 including an image reading section 110 in an upper part thereof, an image forming section 210 in a central part thereof, and a sheet feeding section 250 in a lower part thereof. A platen 111 of transparent glass is disposed on top of the image forming apparatus 100, and an automatic document feeder 112 is provided on the platen 111 for automatically feeding a plurality of original documents one by one onto the platen 111. A post-processing unit 260 is fitted on one side of the image forming section 210, and a multi-tier sheet feeding unit 270 serving also as a pedestal is provided under the sheet feeding section 250.

The image reading section 110 located under the platen 111 has a first scanning unit 113, a second scanning unit 114, an optical lens 115, and a CCD line sensor 116, which is a photoelectric converter. In cooperation with the operation of the automatic document feeder 112, the image reading section 110 reads an image on an original document placed on the platen 111 by relatively scanning the original document at a predetermined exposure position. The first scanning unit 113 is equipped with an light-source lamp unit 1 for illuminating the surface of the original document to light, and a first mirror 2*a* for reflecting a reflected light image from the original document toward a predetermined direction. A light quantity sensor 3 detects the quantity of light emitted from the light-source lamp unit 1. The second scanning unit 114 is equipped with a second mirror 2*b* and a third mirror 2*c* for guiding the reflected light from the original document having being reflected by the first mirror 2*a* to the CCD line sensor 116. The optical lens 115 causes the reflected light from the original document to form an image on the light-receiving surface of the CCD line sensor 116.

The image forming section 210 includes an electrostatic charger 223 for charging a photosensitive drum. 222 to a predetermined potential, a laser scanning unit (hereinafter referred to as "LSU") 227 for forming an electrostatic latent image on the photosensitive drum 222 by emitting laser light according to image data transferred from the image reading section 110 or from an external device, a developing unit 224 for developing the electrostatic latent image formed on the photosensitive drum 222 into a tangible toner image by feeding toner to the electrostatic latent image, a transfer device 225 for transferring the toner image formed on the photosensitive drum 222 onto a recording sheet(used as the recording medium defined by the invention), a cleaner 226 for recovering toner that remains on the photosensitive drum 222 after completion of the transfer step, and a peeler 229 for peeling-off the recording sheet from the photosensitive drum 222 after the completion of the transfer step.

The laser scanning unit 227 includes therein a semiconductor laser 11 for emitting laser light modulated according to the image data, a polygon mirror 12 for deflecting laser light in a primary scanning direction by its rotation, and a group of lenses not shown. The polygon mirror 12 is driven by means of a motor 13, the rotational speed of which is detected by a speed sensor 14.

The image forming section 210 is provided with a fixing unit 217 for fusing the toner image to the recording sheet by heating and pressurizing the recording sheet bearing the toner image transferred thereto. The fixing unit 217 includes a pair of upper and lower rollers, the upper one being a heating roller 21, lower one being a pressurizing roller 22. A temperature sensor 23 detects the temperature of the heating roller 21. Further, the fixing unit 217 is formed on the ejecting side thereof with a switch-back path 221 for reversing the advancing direction of the recording sheet in a double-sided image formation mode for forming images on both sides of the recording sheet.

The recording sheet to which the toner image has been fused at the fixing unit 217 is guided to the post-processing unit 260 by means of sheet ejecting rollers 219, optionally passing through the switch-back path 221. At the post-processing unit 260 the recording sheet is subjected to post-processing such as stapling or punching and then ejected into a tray 261.

The sheet feeding section 250 comprises a manual feed tray 254 fitted on one side of the apparatus body, a double-sided feed unit 255, a sheet feeding tray 251, and sheet feeding trays 252 and 253 provided in the multi-tier sheet feeding unit 270. These trays 251 to 254 each hold plural recording sheets as stacked. The sheet feeding section 250 is provided with conveyor means, such as rollers, for conveying recording sheets fed from the trays 251 to 254 to an image transfer position between the photosensitive drum 222 and the transfer device 225 in the image forming section 210. The double-sided feed unit 255, which communicates with the switch-back path 221 adapted to reverse recording sheets, stores turned-over recording sheets temporarily in the double-sided image formation mode. The double-sided feed unit 255 is replaceable with an ordinary sheet feeding tray.

It is to be noted that the light-source lamp unit 1 and the LSU 227 are each equivalent to the function device defined in the present invention.

In copy-mode processing (including the image reading processing for reading an image on an original document and the image forming processing for copying the image read onto a recording sheet) of the image forming apparatus 100 thus constructed, a copying operation including the image reading processing and the image forming processing is started when the user depressed a start key after having inputted desired conditions (including the number of copies and a magnification) via a condition entry key provided on a control panel not shown following placement of an original document to be copied on the platen 111 of the image reading section 110.

In the image forming apparatus 100, which starts processing in the manner described above, a main driving motor not shown is first actuated substantially simultaneously with the depressing of the start key to cause associated driving gears to rotate. Subsequently, sheet feeding rollers 256 rotate to feed a recoding sheet the recoding sheet which is then conveyed through a conveyance path up to resist rollers 257 at which the recording sheet is stopped temporarily to synchronize with a leading end portion of the image carried on the photosensitive drum 222 and the leading edge of the recording sheet is pressed against the resist rollers 257 for correction of the position thereof.

In reading image information from the original document at the image reading section 110, the copy lamp of the light-source lamp unit 1 is turned on and the scanning unit 113 moves in the direction indicated by arrow A to start exposure scanning. Light emitted from the light-source lamp unit 1 and then reflected by the image-carrying surface of the original document is received by the CCD line sensor 116 via the mirrors 2*a* to 2*c* and optical lens 115, so that the reflected light thus received is read as image information. The image information thus read is converted into digital image data by the image processing circuit of a control section to be described later. The image data is subjected to image processing under established conditions, stored in an image memory temporarily, and then transferred to the LSU 227.

The surface of the photosensitive drum 222 rotating at a predetermined speed becomes uniformly charged to a predetermined potential by the electrostatic charger unit 223 giving electric charge thereto. The LSU 227 drives the semiconductor laser 11 on the basis of the image data transferred from the control section and exposes the surface of the photosensitive drum 222 with laser light modulated according to the image data via the polygon mirror 12 rotating at a predetermined speed. The illumination with laser light by the LSU 227 causes an electrostatic latent image to be formed on the surface of the photosensitive drum 222 on the basis of the image data. The surface of the photosensitive drum 222 on which the electrostatic latent image has been formed is supplied with toner from the developing unit 224, so that the electrostatic latent image is developed into a tangible toner image.

The recording sheet is conveyed to a position between the photosensitive drum 222 and the transfer device 225 by means of the resist rollers 256 which start rotating in synchronism with the rotation of the photosensitive drum 222. The toner image carried on the surface of the photosensitive drum 222 is transferred to the recording sheet at that position by the transfer device 225. Toner remaining on the surface of the photosensitive drum 222 after completion of the transfer is removed and recovered together with paper dust and the like by the cleaner 226.

The recording sheet bearing the transferred toner image is conveyed to the fixing unit 217 where the recording sheet is heated and pressurized while passing between the heating roller 21 and the pressurizing roller 22. The transferred toner image on the recording sheet is fused and fixed firmly to the surface of the recording sheet due to heating and pressurization by the pair of rollers 21 and 22. The recording sheet bearing the toner image thus fused thereto is ejected to the post-processing unit 260 by means of sheet ejecting rollers 219.

Figure 2:
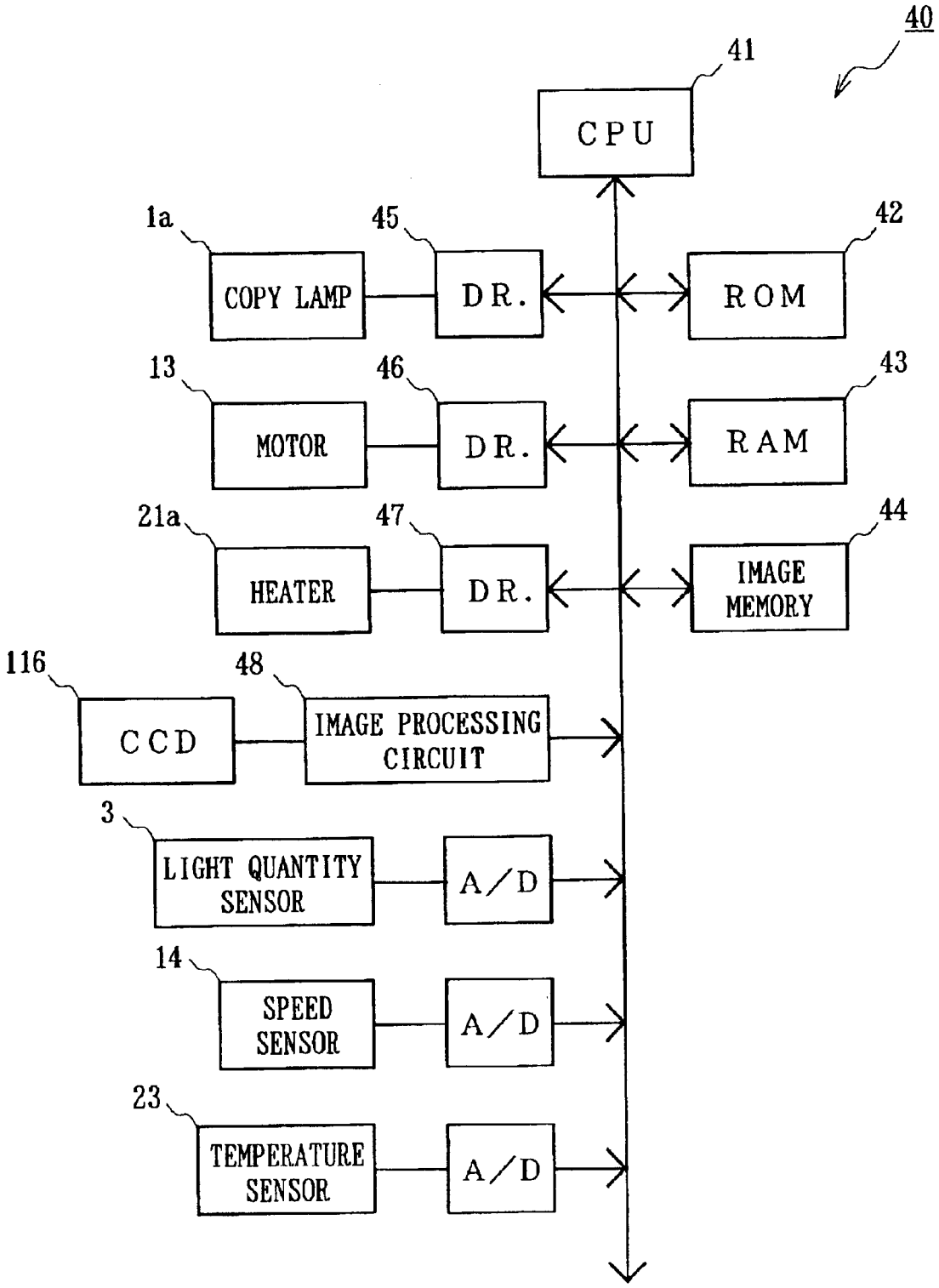
FIG. 2 is a block diagram of the configuration of a control section of the image forming apparatus.

Referring to FIG. 2, control section 40 of the image forming apparatus 100 is configured by connecting a CPU 41 provided with a ROM 42 and a RAM 43 to such components as image memory 44, light quantity sensor 3, speed sensor 14, temperature sensor 23, drivers 45 to 47, image processing circuit 48. The CPU 41, which is the controller defined by the present invention, unifies and controls the associated components according to the program prestored in the ROM 42 and temporarily stores data inputted to and outputted from the associated components in a predetermined memory area of the RAM 43. The image memory 44 stores image data outputted from the image processing circuit 48.

The light quantity sensor 3 detects the quantity of light emitted from the copy lamp la of the light-source lamp unit 1 and inputs the light quantity data thus obtained to the CPU 41. The speed sensor 14 detects the rotational speed of the motor 13 driving the polygon mirror 12 in the LSU 227 and inputs the speed data thus obtained to the CPU 41. The temperature sensor 23 detects the temperature of the heating roller 21 in the fixing unit 217 and inputs the temperature data thus obtained to the CPU 41.

The driver 45 drives the copy lamp la of the light-source lamp unit 1 on the basis of control data outputted from the CPU 41 The driver 46 drives the motor in the LSU 227 on the basis of control data outputted from the CPU 41. The driver 47 drives heater 21*a* incorporated in the heating roller 21 of the fixing unit 217 on the basis of control data outputted from the CPU 41.

Besides the associated components described above, a multiplicity of components adapted to operate in the image reading processing and image forming processing, including a main motor, other motors, clutches, solenoids and sensors in the image forming apparatus 100, are connected to the CPU 41. The CPU 41 reads data detected by each sensor with predetermined timing in the image reading processing and image forming processing and drives a pertinent motor or the like on the basis of the data thus detected.

Figure 3:
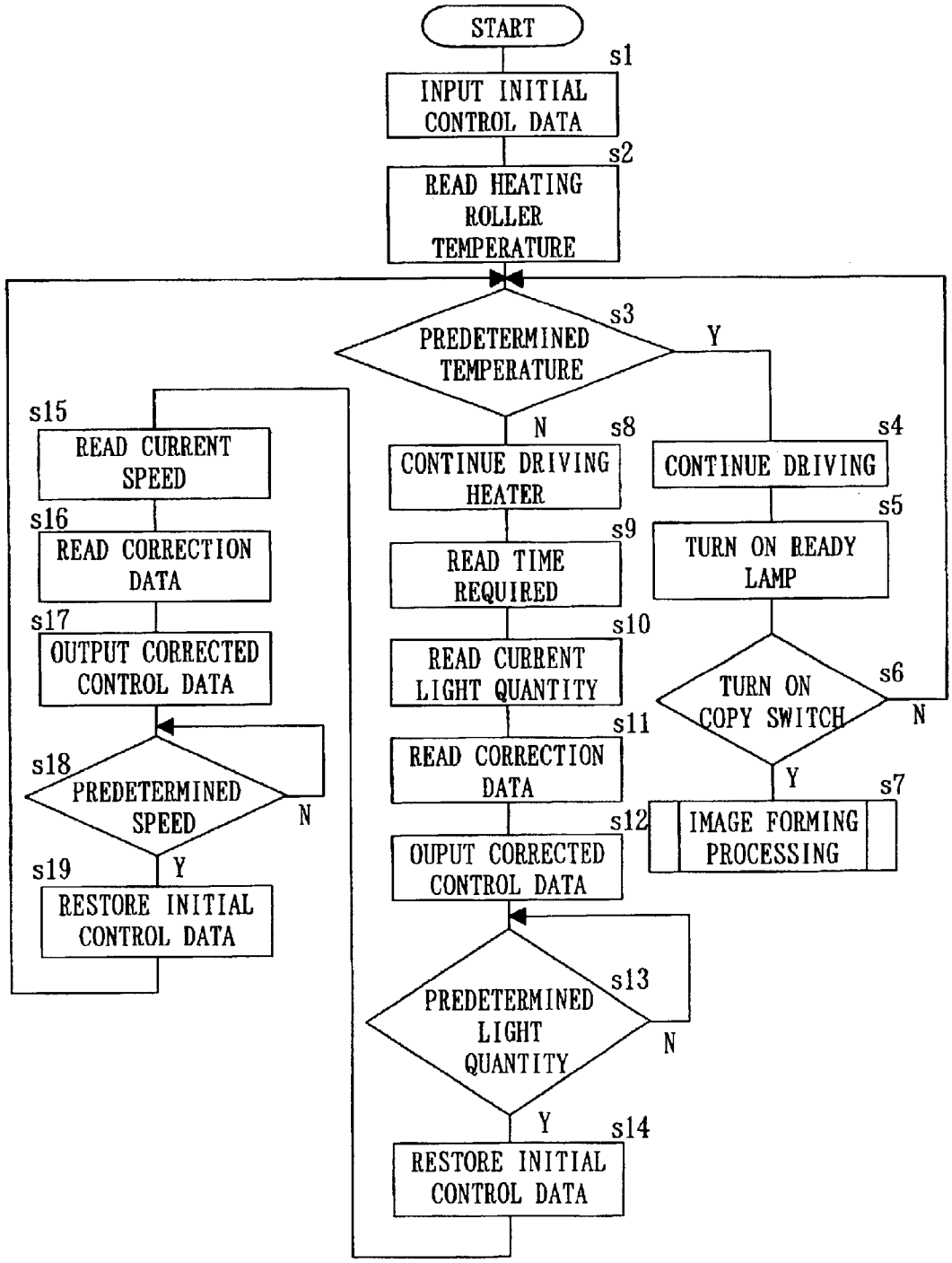
FIG. 3 is a flowchart of a principal part of the procedure of processing executed by the control section of the image forming apparatus.

Referring to the flowchart at FIG. 3, description will be made of a part of the processing procedure at the control section of the above-described image forming apparatus 100. In the image forming apparatus 100, the heating roller 21 of the fixing unit 227 for fusing a toner image and pressure-bonding it to a recording sheet by heating and pressurizing the recording sheet needs to be heated to the predetermined temperature that allows the toner image to fuse from the starting of the image forming processing. The copy lamp la of the light-source lamp unit 1 for illuminating an original document placed on the platen 111 to read image information from the original document needs to emit the predetermined quantity of light sufficient to obtain image data of a proper density from the starting of the image reading processing. The polygon mirror 12 of the LSU 227 for scanning the surface of the photosensitive drum 222 with laser light modulated according to image data needs to rotate at the predetermined speed commensurate with the writing speed from the starting of the image forming processing.

In order to turn such function devices into respective predetermined operable conditions (inclusive of the aforementioned predetermined temperature, predetermined light quantity and predetermined speed) prior to the starting of the image reading processing and the image forming processing and immediately after the starting of energization of the function devices in response to power-on of the image forming apparatus 100 or immediately after the resuming of energization of the function devices following the completion of settlement of a trouble such as jam, the control section 40 of the image forming apparatus 100 executes the following initialization processing.

When the image forming apparatus 100 is powered on, the CPU 41 outputs initial control data to the drivers 45 to 47 (step s1) to start driving the copy lamp 1*a*, motor 14 and heater 21*a*. Subsequently, the CPU 41 reads the temperature of the surface of the heating roller 21 of the fixing unit 217 detected by the temperature sensor 23 (step s2) and judges whether the temperature thus read is the predetermined temperature that allows toner to fuse (step s3). If the surface temperature of the heating roller 21 has reached the predetermined temperature, the CPU 41 judges that the apparatus 100 is in a state ready to start the image forming processing, and continues driving the copy lamp 1*a*, motor 14 and heater 21*a* according-to the initial control data to maintain their respective predetermined conditions (step s4). Then, the CPU 41 turns on the ready lamp of the control panel (step s5) and waits for the user to depress the copy switch to give the apparatus 100 an instruction to start the image forming processing (step s6). The CPU 41 starts executing the image reading processing and the image forming processing in response to the depressing of the copy switch (step s7).

Figure 4:
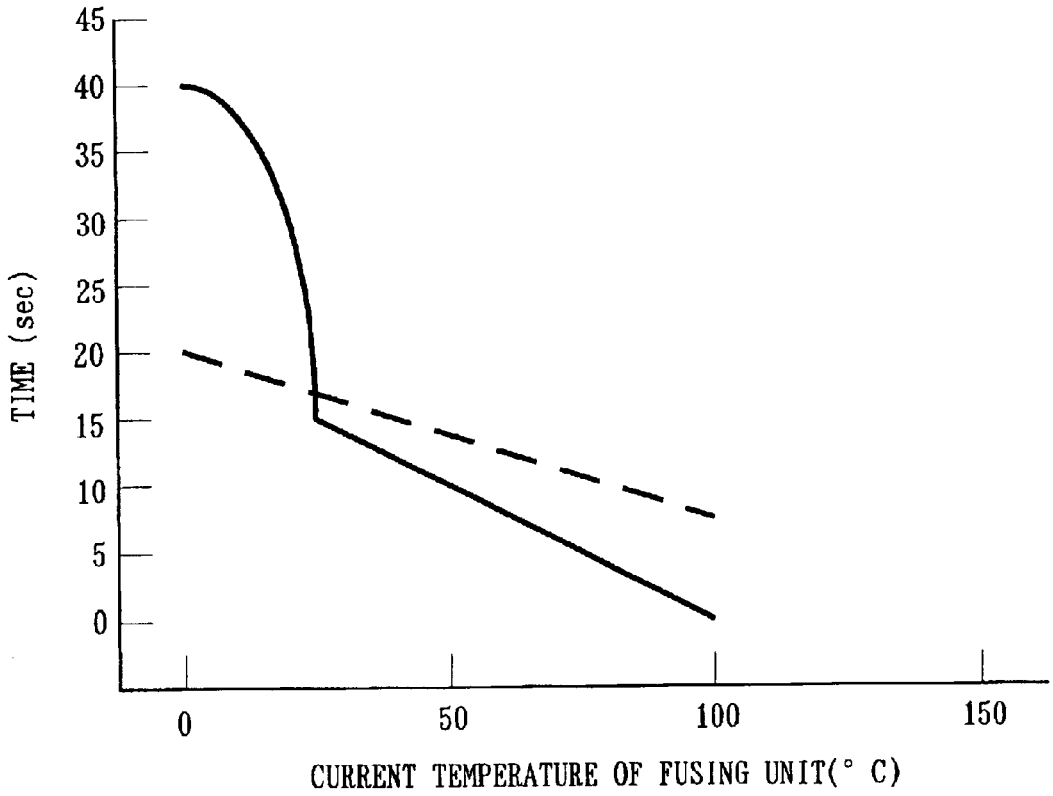
FIG. 4 is a diagram showing the relationship between the current temperature of a fixing unit of the image forming apparatus and the time required for the fixing unit to reach a predetermined temperature and the relationship between the current temperature of the fixing unit and the time required for a copy lamp used in a light source unit of the image forming apparatus to reach a predetermined light quantity.

If the surface temperature of the heating roller 21 has not reached the predetermined temperature yet, the CPU 41 continues driving the heater 21*a* according to the initial control data (step S8) and reads the time required corresponding to the temperature (current temperature) of the heating roller 21 from information stored in the ROM 42 on the relationship between the current temperature of the heating roller 21 and the time required (step s9). The ROM 42, which serves as the first memory and second memory defined by the present invention, stores the information on the relationship between the current temperature of the heating roller 21 and the time required, an example of which is plotted with the broken line in FIG. 4. The "time required", as used herein, is the time required for the temperature of the heating roller 21 to reach the predetermined temperature, for example 175° C., from the current temperature of the heating roller 21. It is possible that a relational expression representing the relationship shown in FIG. 4 is prestored in the ROM 42 and the time required corresponding to the current temperature is calculated at the step s9.

Thereafter, the CPU 41 reads light quantity data of the copy lamp 1*a* detected by the light quantity sensor 3 as the current light quantity (step s10) and reads correction data consistent with the current light quantity and with the time required from information stored in the ROM 42 on the relationship of correction data to the current light quantity and to the time required (step s11). Subsequently, the CPU 41 outputs corrected control data to the driver 45 (step s12), the corrected control data being obtained by correcting the initial control data according to the correction data thus read. When the current light quantity of the copy lamp la reaches the predetermined light quantity, the CPU 41 restores the control data to be outputted to the driver 45 to the initial control data (steps s13 and s14).

The correction data stated above is data for determining an electric energy to be added to the electric energy that is supplied to the copy lamp 1*a* according to the initial control data in order for the light quantity of copy lamp 1*a* to reach the predetermined light quantity by the time when the predetermined time required elapses. For example, in adjusting the electric energy for driving the copy lamp 1*a* by varying the duty ratio of driving pulses according to the control data inputted to the driver 45 from the CPU 41, the initial duty ratio corresponding to the initial control data is increased by an amount of correction corresponding to the correction data. The ROM 42 stores the information on such a relationship of correction data to the current light quantity and the time required that the correction data decreases with increasing current light quantity and increases with decreasing time required. While this relationship can be determined experimentally, the correction data need not necessarily vary continuously with varying current light quantity and with varying time required and it is sufficient for the ROM 42 to store at least one correction data item selected consistently with the current light quantity and with the time required.

When the light quantity of the copy lamp 1*a* and the temperature of the heating roller 21 of the heating unit 217 have reached the predetermined light quantity and the predetermined temperature, respectively, within the time required, the light-source lamp unit 1 is in a condition capable of properly reading the image carried on the original document in the image reading section 110.

In the case where the copy lamp 1*a* is a cold cathode tube, the time required for the light quantity of the copy lamp 1*a* to reach the predetermined light quantity depends on the bulb temperature of the copy lamp 1*a*. The bulb temperature of the copy lamp 1*a* is influenced by the temperature of the heating roller 21 disposed in the image forming apparatus 100 together with the copy lamp 1*a*, as plotted with the solid line in FIG. 4. As a result, the time required for the light quantity of the copy lamp 1*a* to reach the predetermined light quantity depends also on the temperature of the heating roller 21. For this reason, the correction data stored in the ROM 42 may be data prepared taking the current temperature of the heating roller 21 into consideration.

Further, the CPU 41 reads speed data of the motor 13 detected by the speed sensor 14 as the current speed (step s15) and reads correction data consistent with the current speed and with the time required from information stored in the ROM 42 on the relationship of correction data to the current speed and to the time required (step s16). Subsequently, the CPU 41 outputs corrected control data to the driver 45 (step s17), the corrected control data being obtained by correcting the initial control data according to the correction data thus read. When the current rotational speed of the motor 13 reaches the predetermined speed, the CPU 41 restores the control data to be outputted to the driver 45 to the initial control data (steps s18 and s19).

The correction data stated above is data for determining an electric energy to be added to the electric energy that is supplied to the motor 13 according to the initial control data in order for the rotational speed of the motor 13 to reach the predetermined speed by the time when the time required elapses. For example, in adjusting the electric energy for driving the motor 13 by varying the duty ratio of driving pulses according to the control data inputted to the driver 46 from the CPU 41, the initial duty ratio corresponding to the initial control data is increased by an amount of correction corresponding to the correction data. The ROM 42 stores the information on such a relationship of correction data to the current speed and to the time required that the correction data decreases with rising current speed and increases with decreasing time required. While this relationship can be determined experimentally, the correction data need not necessarily vary continuously with varying current speed and with varying time required and it is sufficient for the ROM 42 to store at least one correction data item selected consistently with the current light quantity and with the time required.

When the rotational speed of the motor 14 and the temperature of the heating roller 21 of the fixing unit 217 have reached the predetermined speed and the predetermined temperature, respectively, within the time required, the polygon mirror 12 of the LSU 227 rotates at a speed that allows image data to be written on the photosensitive drum 222 at a proper writing speed.

Figure 5A:
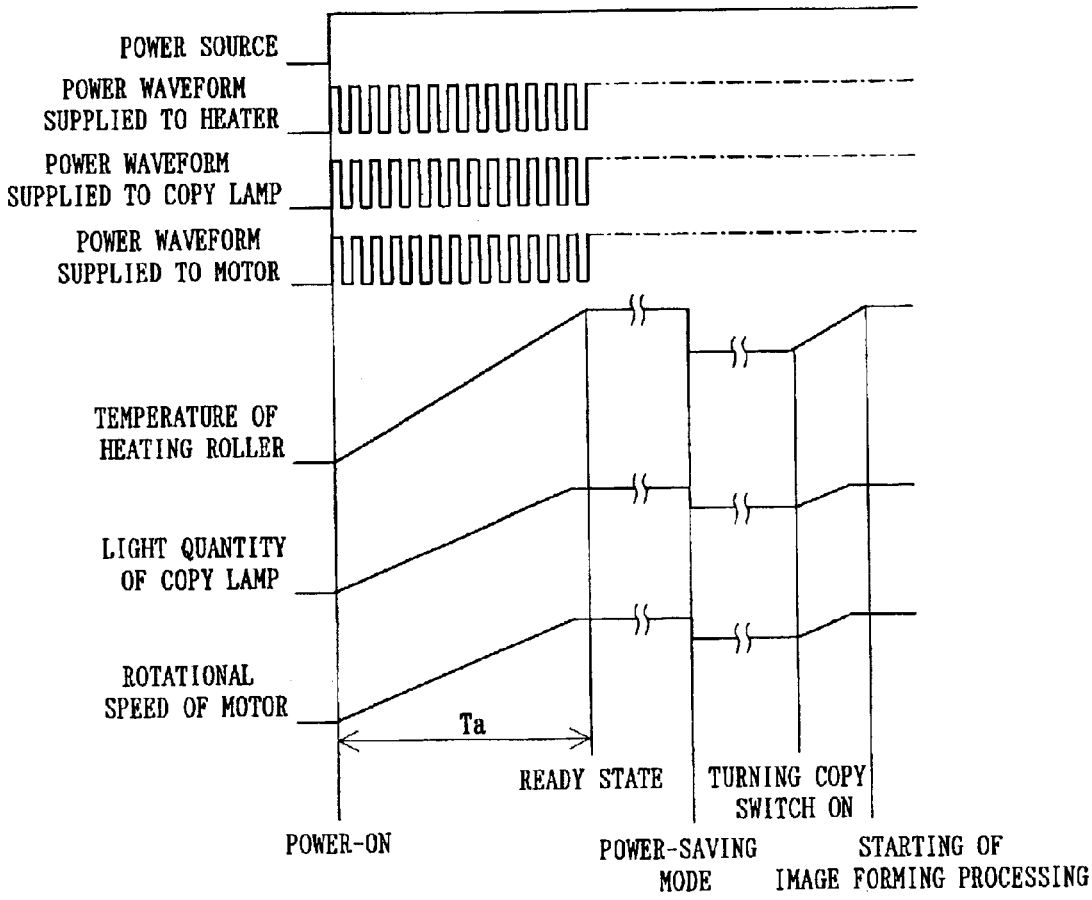
FIGS. 5A and 5B are each a diagram showing how a heating roller of the fixing unit, the copy lamp of the light-source lamp unit and a motor associated with a polygon mirror of the laser scanning unit (LSU) are driven in the image forming apparatus.

As shown in FIG. 5A, in the case where the current temperature of the heating roller 21 of the fixing unit 217 is relatively low and, hence, the time required Ta for the temperature of the heating roller 21 to reach the predetermined temperature is relatively long at the time immediately after the starting of energization of the function devices in response to power-on of the image forming apparatus 100 or immediately after the resuming of energization of the function devices following the completion of settlement of a trouble such as jam, the light quantity of the copy lamp 1*a* and the rotational speed of the motor 13 reach the predetermined light quantity and the predetermined speed, respectively, prior to the elapse of the time required Ta even if the copy lamp la and the motor 13 are driven continuously according to the initial control data. For this reason, the CPU 41 continues feeding the initial control data to the driver 45 driving the copy lamp la and to the driver 46 driving the motor 13 during the warm-up time up to the time when the temperature of the heating roller 21 reaches the predetermined temperature.

Figure 5B:
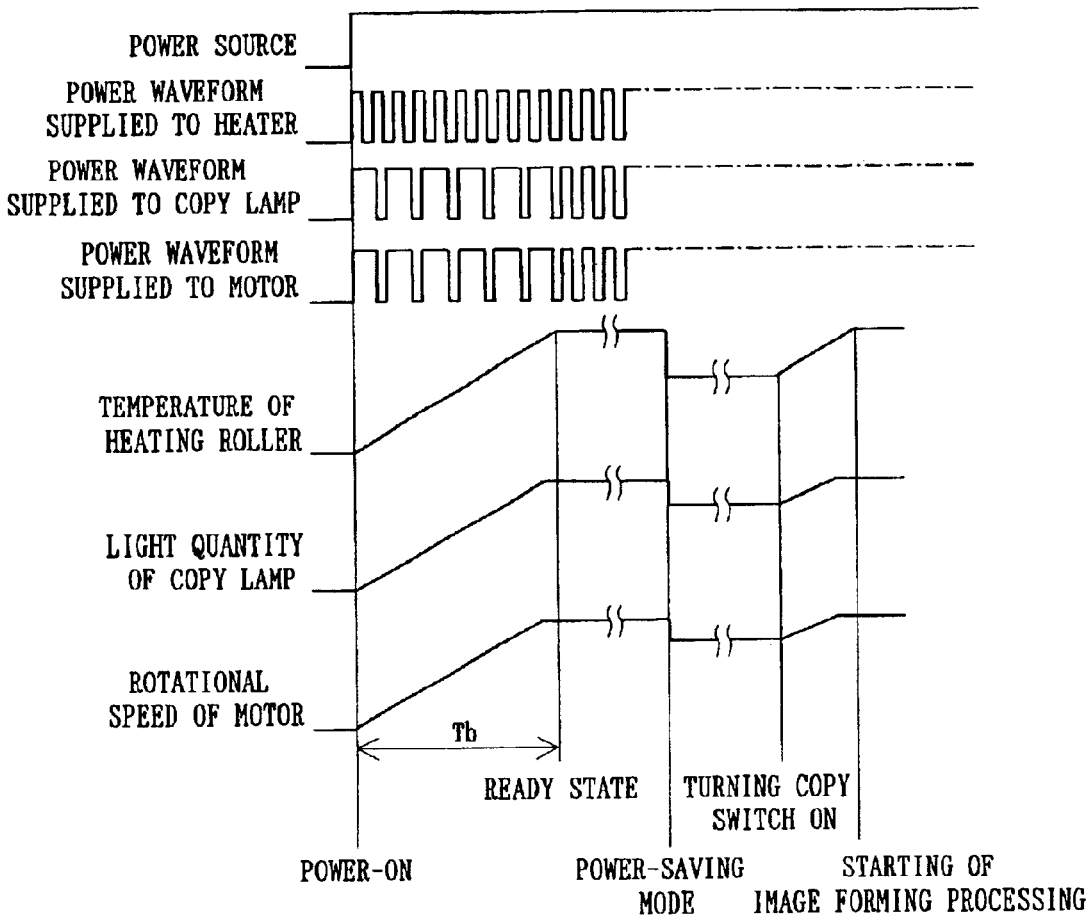

As shown in FIG. 5B, on the other hand, in the case where the current temperature of the heating roller 21 of the fixing unit 217 is relatively high and, hence, the time required Tb for the temperature of the heating roller 21 to reach the predetermined temperature is relatively short at the time immediately after the starting of energization of the function devices in response to power-on of the image forming apparatus 100 or immediately after the resuming of energization of the function devices following the completion of settlement of a trouble such as jam, the light quantity of the copy lamp 1*a* and the rotational speed of the motor 13 do not reach the predetermined light quantity and the predetermined speed, respectively, prior to the elapse of the time required Tb if the copy lamp 1*a* and the motor 13 are driven continuously according to the initial control data. For this reason, the CPU 41 feeds corrected control data having a higher duty ratio than does the initial control data to the driver 45 driving the copy lamp 1*a* and to the driver 46 driving the motor 13 during the warm-up time up to the time when the temperature of the heating roller 21 reaches the predetermined temperature. By so doing, the predetermined light quantity of the copy lamp 1*a* and the predetermined speed of the motor 13 can be reached within the warm-up time up to the time when the temperature of the heating roller 21 reaches the predetermined temperature, irrespective of the current temperature of the heating roller 21.

Thus, the image forming apparatus 100 is configured to determine the time required for the temperature of the heating roller 21 to reach the predetermined temperature from the temperature of the heating roller 21 of the fixing unit 217 measured at the time the apparatus 100 is powered on and modify control over other function devices, such as the light-source lamp unit 1 and the LSU 227, on the basis of the time required thus determined so as to turn the other function devices into their respective predetermined conditions suited for the image forming processing, whereby all the other function devices are already turned into their respective predetermined operable conditions when the temperature of the heating roller 21 of the fixing unit 217 reaches the predetermined temperature. In this way the present invention is capable of realizing an immediate printing type image forming apparatus by sufficiently shortening the warm-up time without causing any trouble to occur in the image forming operation.

It is to be noted that the CPU 41 may be configured to cause the steps s15 to s19 to be performed at the same time with respective steps s10 to s14.

In determining correction data at each of the steps s11 and s16, it is possible to employ a configuration such as to determine the time required to raise the light quantity of the copy lamp 1*a* from the current light quantity to the predetermined light quantity or the time required to raise the rotational speed of the motor 13 driving the polygon mirror 12 from the current speed to the predetermined speed and then select or calculate correction data such that the time required thus determined becomes shorter than the predetermined time required.

Where the developing unit 224 of the image forming apparatus 100 is adapted to contain a two-component developer comprising toner and carrier, a toner replenishing operation for maintaining the toner concentration in the two-component developer at a predetermined concentration level or higher needs to have been completed prior to the starting of the image forming processing in order to form a toner image having a proper density at the developing step of the image forming processing. In view of this, control data for controlling a motor driving a toner-replenishing roller may be corrected depending on the current concentration of toner in the two-component developer and on the time required in a manner similar to the procedure from the step s15 to the step s19.

Where the image forming apparatus 100 operates in a power-saving mode in which the temperature of the heating roller 21, the light quantity of the copy lamp la and the rotational speed of the motor 13 are limited lower than their respective predetermined conditions if a predetermined period of time from the turning-on of the ready lamp has elapsed without manipulation of the copy switch, the present invention may be applied to a reset operation during the period of time from the manipulation of the copy switch in the power-saving mode up to the starting of the image forming processing so that control data to be fed to each of the drivers 45 and 46 is corrected.

The present invention provides the following advantages.

By employing the configuration adapted to measure the current temperature of the fixing unit immediately after energization of function devices, determine the time required corresponding to the current temperature from the information on the relationship stored in the first memory, and modify control over the function devices so that the function devices are turned into respective predetermined conditions suited for the execution of image forming processing within the time required thus determined, it becomes possible that the time required for each of the function devices other than the fixing unit to turn into respective predetermined condition is controlled depending on the time required for the temperature of the fixing unit to reach the predetermined temperature from the starting of energization, and that when the temperature of the fixing unit reaches the predetermined temperature suited to heat the recording medium after energization of each function device, the other function devices also are already turned into their respective conditions suited for the execution of image forming processing. As a result, no trouble occurs in the image forming processing even though the warm-up time is shortened. Since the required warm-up time can be shortened sufficiently, the present invention can realize an immediate printing type image forming apparatus.

Since the time required for each of the other function devices to turn into respective predetermined condition from the starting of energization of the other function devices varies with varying efficiency in energizing each of the other function devices, control over the other function devices to turn into their respective predetermined conditions within the time required for the temperature of the fixing unit to reach the predetermined temperature from the starting of energization can be exercised easily and accurately by adjusting the efficiency in energizing each of the other function devices depending on the time required for the temperature of the fixing unit to reach the predetermined temperature from the starting of energization.

By determining an energization efficiency consistent with the current condition and the predetermined condition of each of the other function devices and with the time required from information stored in the second memory on the relationship between the energization efficiency and the rate of change of condition in adjusting the efficiency in energizing each of the other function devices depending on the time required for the temperature of the fixing unit to reach the predetermined temperature from the starting of energization, an energization efficiency to be set for each of the other function devices to turn into respective predetermined condition within the time required for the temperature of the fixing unit to reach the predetermined temperature from the starting of energization can be determined accurately.

By exercising normal control over the other function devices once the temperature of the fixing unit has reached the predetermined temperature and the other function devices have turned into their respective predetermined conditions after the starting of energization, each of the function devices can be maintained in a condition that enables the image forming processing to be performed properly after the image forming apparatus has turned into a state allowing the execution of the image forming processing.

By modifying control over the light-source lamp unit illuminating an original document with light for reading image information from the original document or the laser scanning unit scanning with laser light according to the image information by means of the polygon mirror depending on the time required for the temperature of the fixing unit to reach the predetermined temperature, the warm-up time can be shortened sufficiently without any trouble in the execution of the image reading processing or the image forming processing since, when the temperature of the fixing unit reaches the predetermined temperature suited for heating of a recording medium after energization of the function devices, the light quantity of the light-source lamp unit has reached the predetermined light quantity suited for reading of the image information from the original document or the rotational speed of the polygon mirror of the laser scanning unit has reached the predetermined speed suited for scanning with laser light according to the image information. Thus, an immediate printing type image forming apparatus can be realized.

While only a certain presently preferred embodiment of the present invention have been described in detail, as will be apparent for those skilled in the art, certain changes and modifications may be made in embodiments without departing from the spirit and scope of the present invention as defined by the following claims.

What is claimed is:

1. An image forming apparatus comprising:

a fixing unit operative to heat a recording medium bearing a toner image transferred thereto at a predetermined temperature;

at least one function device other than the fixing unit for use in image formation;

a first memory storing information on a relationship between a current temperature of the fixing unit and a time required for the fixing unit to reach a predetermined temperature; and a controller operative to determine a time required corresponding to a current temperature of the fixing unit measured immediately after starting of energization from the information on the relationship stored in the first memory and modify control over the at least one function device to turn the at least one function device into a predetermined condition within the determined time required.

2. The image forming apparatus according to claim 1, wherein the controller is operative to determine an energization efficiency for turning the at least one function device into the predetermined condition within the determined time required.

3. The image forming apparatus according to claim 2, further comprising a second memory storing information on a relationship between an energization efficiency and a rate of change of condition with respect to the at least one function device, wherein the controller is operative to determine an energization efficiency consistent with a current condition of the at least one function device measured immediately after the energization, with the predetermined condition of the at least one function device and with the determined time required from the information on the relationship stored in the second memory.

4. The image forming apparatus according to claim 1, wherein the controller is operative to restore unmodified control when the at least one function device reaches the predetermined condition.

5. The image forming apparatus according to claim 1, wherein the at least one function device is one of a light-source lamp unit operative to illuminate an original document with a predetermined quantity of light for reading image information from the original document and a laser scanning unit operative to scan with laser light according to the image information by means of a polygon mirror rotating at a predetermined speed.

6. An initialization control method for image forming apparatus, comprising the steps of:

measuring a current temperature of a fixing unit immediately after starting of energization;

determining a time required for the fixing unit to reach a predetermined temperature from the current temperature thus measured; and modifying control over at least one function device other than the fixing unit so as to turn the at least one function device into a predetermined condition within the determined time required.

7. The method according to claim 6, wherein the step of modifying control is the step of determining an energization efficiency for turning the at least one function device into the predetermined condition within the determined time required.

8. The method according to claim 6, wherein the step of modifying control includes the step of restoring unmodified control when the at least one function device reaches the predetermined condition.

9. The method according to claim 6, wherein the step of modifying control includes illuminating an original document with a predetermined quantity of light for reading image information from the original document using a light-source lamp unit.

10. The method according to claim 6, wherein the step of modifying control includes scanning the image information by means of a polygon mirror rotating at a predetermined speed using a laser scanning unit.

11. An immediate printing type image forming apparatus comprising:

a fixing unit operative to heat a recording medium bearing a toner image transferred thereto at a predetermined temperature;

at least one function device other than the fixing unit for use in image formation;

a first memory storing information on a relationship between a current temperature of the fixing unit and a time required for the fixing unit to reach a predetermined temperature; and a controller operative to determine a time required corresponding to a current temperature of the fixing unit measured immediately after starting of energization from the information on the relationship stored in the first memory and modify control over the at least one function device other than said fixing unit to bring said at least one function device other than said fixing device into a predetermined operable condition within the determined time required; and wherein the controller brings the at least one function device other than the fixing device into the predetermined operable condition prior to or at the same time as the fixing unit is brought to the predetermined temperature.

12. The image forming apparatus according to claim 11, wherein the controller is operative to determine an energization efficiency for turning the at least one function device other than the fixing device into the predetermined condition within the determined time required.

13. The image forming apparatus according to claim 12, further comprising a second memory storing information on a relationship between an energization efficiency and a rate of change of condition with respect to the at least one function device, wherein the controller is operative to determine an energization efficiency consistent with a current condition of the at least one function device measured immediately after the energization, with the predetermined condition of the at least one function device and with the determined time required from the information on the relationship stored in the second memory.

14. The image forming apparatus according to claim 11, wherein the controller is operative to restore unmodified control when the at least one function device reaches the predetermined condition.

15. The image forming apparatus according to claim 11, wherein the at least one function device is one of a light-source lamp unit operative to illuminate an original document with a predetermined quantity of light for reading image information from the original document and a laser scanning unit operative to scan with laser light according to the image information by means of a polygon mirror rotating at a predetermined speed.

16. An initialization control method for image forming apparatus, comprising the steps of:

measuring a current temperature of a fixing unit immediately after starting of energization;

determining a time required for the fixing unit to reach a predetermined temperature from the current temperature thus measured; and modifying control over at least one function device other than the fixing unit so as to turn the at least one function device into a predetermined condition within the determined time required, wherein the step of modifying control over the at least one function device other than the fixing device includes turning the at least one function device other than the fixing device into the predetermined operable condition prior to or at the same time as the fixing unit is brought to the predetermined temperature.

17. The method according to claim 16, wherein the step of modifying control is the step of determining an energization efficiency for turning the at least one function device into the predetermined condition within the determined time required.

18. The method according to claim 16, wherein the step of modifying control includes the step of restoring unmodified control when the at least one function device reaches the predetermined condition.

* * * * *